United States Patent [19]

Roy et al.

[11] Patent Number: 4,926,046

[45] Date of Patent: May 15, 1990

[54] VOLUMETRICALLY EFFICIENT CONTAINER APPARATUS

[75] Inventors: Bryan A. Roy, Harrison, N.J.; John G. Funk, Raleigh, N.C.; Bruce S. Rowe, Silver Spring, Md.

[73] Assignee: Westinghouse Electric Corp., Pittsburgh, Pa.

[21] Appl. No.: 283,412

[22] Filed: Dec. 12, 1988

[51] Int. Cl.[5] ..... G21F 5/00

[52] U.S. Cl. ..... 250/506.1; 376/272; 252/633

[58] Field of Search ..... 250/506.1; 376/272; 252/633; 220/409; 206/804

[56] References Cited

U.S. PATENT DOCUMENTS

| | | | |
|---|---|---|---|
| 2,514,909 | 7/1950 | Strickland . | |
| 3,111,586 | 11/1963 | Rogers . | |
| 3,391,280 | 7/1968 | Bonilla et al. | 250/506.1 |
| 3,483,380 | 12/1969 | Antonsen et al. . | |
| 3,732,427 | 5/1973 | Trudeau et al. . | |
| 4,116,337 | 9/1978 | Backus | 250/506.1 |
| 4,223,575 | 9/1980 | Krueger . | |
| 4,336,460 | 6/1982 | Best et al. | 250/506.1 |
| 4,414,475 | 11/1983 | Kratz et al. . | |
| 4,532,104 | 7/1985 | Wearden et al. . | |
| 4,610,839 | 9/1986 | Geier et al. | 250/506.1 |
| 4,625,122 | 11/1986 | Botzen et al. | 250/506.1 |
| 4,647,213 | 3/1987 | Hay, II . | |
| 4,666,676 | 5/1987 | Nelson et al. | 252/633 |
| 4,680,159 | 7/1987 | Lahr et al. . | |
| 4,681,706 | 7/1987 | Mallory et al. . | |
| 4,728,136 | 3/1988 | Newhouse et al. | 250/506.1 |
| 4,754,894 | 7/1988 | Simon et al. | 250/506.1 |

FOREIGN PATENT DOCUMENTS 53006798 7/1976 Japan .

OTHER PUBLICATIONS

Marketing Brochure, "Radioactive Waste Dewatering Services", authored by Hittman Nuclear Incorporated, distributed to potential customers approximately Mar. 1988.

Marketing Brochure, "Radioactive Waste Solidification Services", authored by Hittman Nuclear Incorporated, distribution to potential customers approximately Mar. 1988.

Letter from Ronald A. Sharp, Senior Technical Representative, Hittman Nuclear to S. L. Mills, Cleveland Electric Illuminating Company, dated Nov. 13, 1987.

*Primary Examiner*—Bruce C. Anderson

*Attorney, Agent, or Firm*—Walter S. Stevens

[57] ABSTRACT

Volumetrically efficient radioative waste container apparatus, wherein the container apparatus includes a plurality of open pockets recessed into the outside surface of the container, a plurality of lifting lugs each completely disposed within and attached to each pocket and further includes a container adaptor capable of being connected to the lifting lugs for reacting torque and lifting loads and for lifting the container. An opening is provided in the container for filling the container with waste. A coupling is provided in the opening as an attachment point for a mixing blade assembly which mixes and homogenizes the waste transferred into the container. A motor is connected to the adaptor for rotating the mixing blade. The adaptor further includes arms and lifting brackets for transferring the motor's torque to the lifting lugs. The adaptor also includes stiffeners attached to the motor, the arms, and to the lifting brackets for resisting the torque transferred to the lifting lugs. The lifting lugs do not protrude beyond the external surface of the container; thererfore, the volume defined by the external envelope of the container is minimized.

20 Claims, 8 Drawing Sheets

FIG. 4
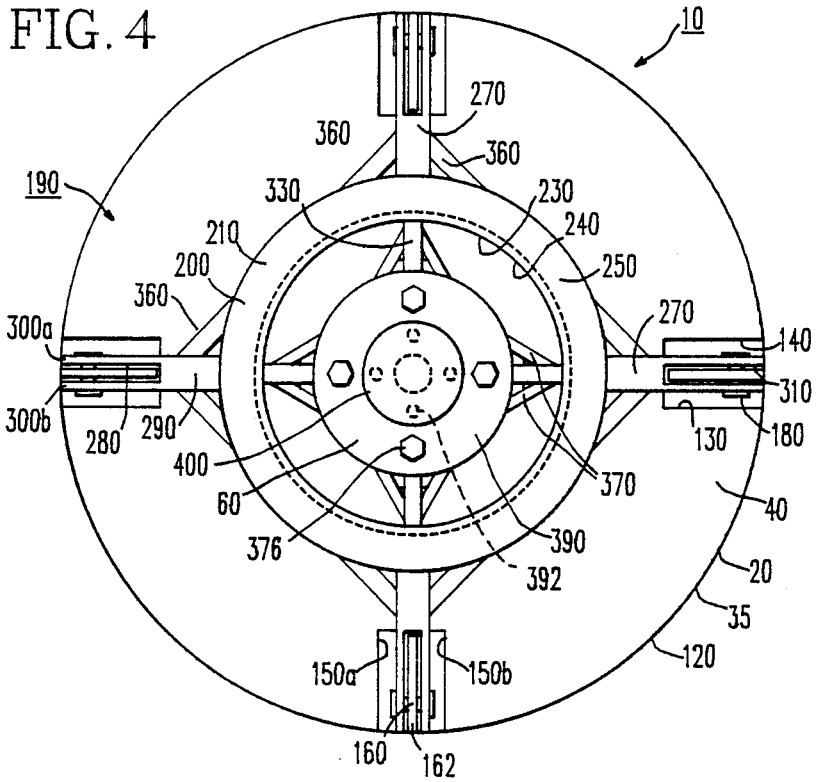
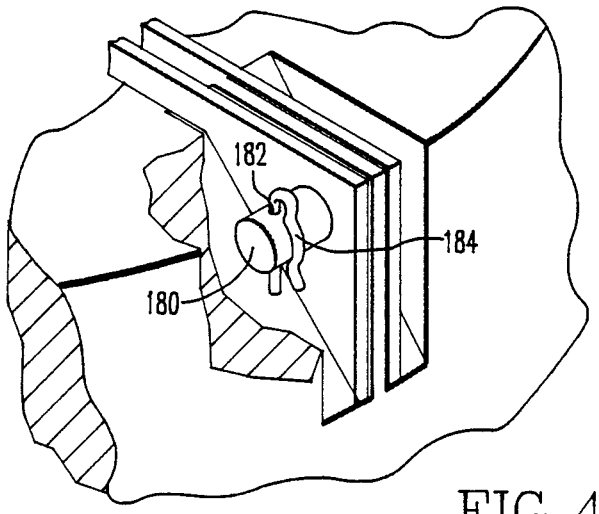
FIG. 4A

FIG. 8
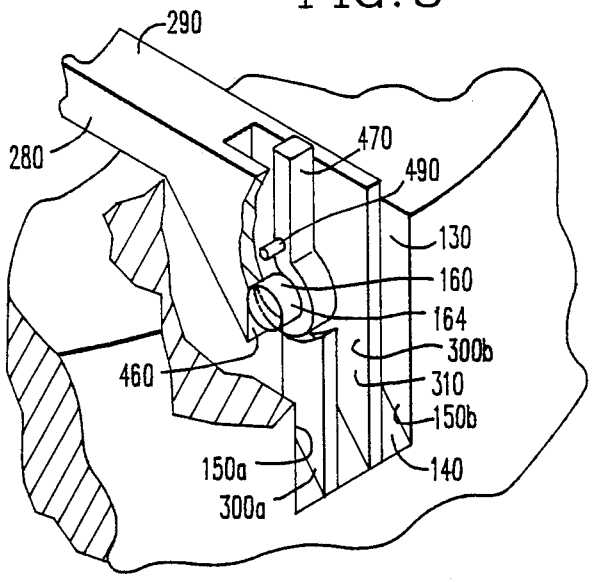
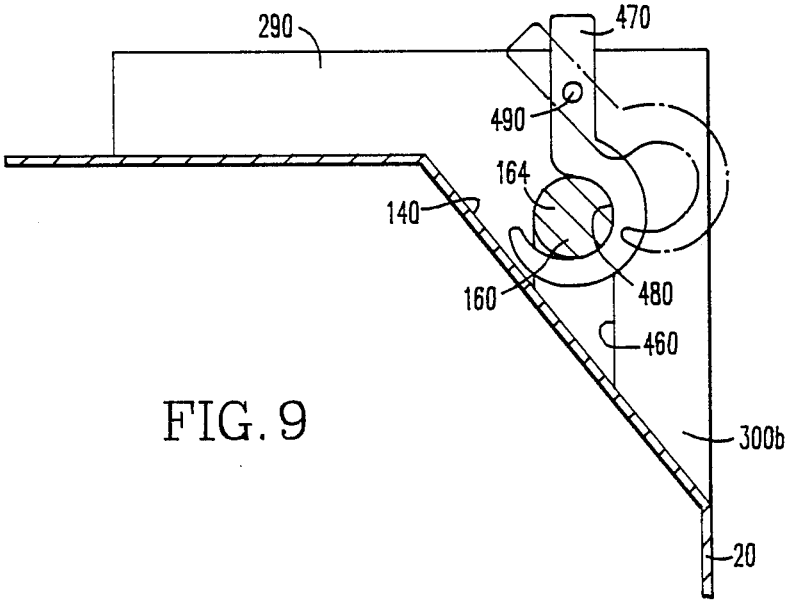
FIG. 9

VOLUMETRICALLY EFFICIENT CONTAINER APPARATUS

BACKGROUND OF THE INVENTION

This invention generally relates to container apparatus and more particularly relates to a volumetrically efficient radioactive waste container apparatus, wherein the volumetrically efficient container apparatus includes a plurality of pockets recessed into the outside surface of the container, a plurality of lifting lugs each completely disposed within and attached to each pocket and further includes container adaptor means capable of being connected to the lifting lugs for reacting torque and lifting loads and for lifting the container.

Low-level radioactive waste generated by nuclear reactor power plants, governmental operations, hospitals and the like are packaged in containers for disposal at burial sites licensed by the United States government for such disposal. Often these wastes are in the form of spent ion exchange resins, filter media, waste sludge, chemical precipitates, and similar granular-type slurry media which result from water treatment processes in the facilities generating the wastes. Of course, these wastes should be isolated from the environment for biological and health reasons. In this regard, burial of low-level radioactive wastes is a relatively inexpensive means for isolating the wastes and for providing adequate long-term shielding from the radiation emitting from the wastes. However, the owner of the waste container to be buried is assessed certain burial fees or charges. The charges assessed the owner of the waste container are directly proportional to the volume of the external envelope defined by the container. That is, the greater the volume of the external envelope defined by the container, the greater the charges assessed the container owner. Therefore, it is desirable to design a volumetrically efficient waste container that minimizes the volume of the external envelope mentioned above and that can maximize the volume of waste material to be buried.

Many past and present designs for radioactive waste containers use a protruding fill neck at the top of the container as an opening for waste and process chemical additions as well as the attachment point for mixing blade drivers or other process flanges Of course, a sacrificial mixing blade is connected to the mixing blade driver and is disposed in the container for mixing the waste. Because the protruding fill neck extends beyond the top of the container it therefore increases the volume of the external envelope of the container. Therefore, a problem in the art has been to design a container having a fill connection that does not protrude above the top of the container.

As stated above, in many past and present designs the mixing blade driver is attached to the top of the container. It will be understood that the mixing blade driver is a motor that develops torque for rotating the mixing blade. Because the mixing blade driver is attached to the top of the container, the top of the container will thus experience the torque produced by the mixing blade driver. Therefore, the top of many past and present containers include structural members to accommodate the effects of the torque produced by the mixing blade driver. These structural members increase the volume of the external envelope defined by the container. Therefore, yet another problem in the art has been to accommodate the effects of the torque produced by the mixing blade driver while eliminating the structural members.

Moreover, many past and present designs for radioactive waste containers use container lifting lugs that protrude perpendicularly outwardly from the surface of the container. These protruding lifting lugs therefore increase the volume of the external envelope of the container. Moreover, when these lifting lugs protrude from the top surface of the container and are attached to lifting cables and pulled, a tensile load is applied to these lugs, which tensile load will tend to pull and separate these lugs from the top of the container. Therefore, still another problem in the art has been to design a container that does not have protruding lifting lugs and that does not have lifting lugs that will experience significant tensile load when pulled.

As stated hereinabove, radioactive waste containers are known. A container or flask for the transport and storage of irradiated nuclear fuel elements is disclosed in U.S. Pat. No. 4,532,104 issued July 30, 1985, in the name of Sydney Wearden et al. entitled "Transport and Storage Flask for Nuclear Fuel". The Wearden patent discloses a hollow flask for receiving irradiated nuclear fuel, the flask comprising a cylindrical container lined with stainless steel, and having a removable lid. Trunnions are provided at the ends of the container for use with lifting gear However, the Wearden et al. patent does not appear to disclose container adaptor means capable of being connected to the trunnions for reacting torque and lifting loads and for lifting the container.

A shielding container for storing weak to medially active waste in a storage barrel or drum which is surrounded by the shielding container is disclosed by U.S. Pat. No. 4,414,475 issued Nov. 8, 1938, in the name of Gerhard Kratz et al. entitled "Shielding Container for Storing Weak to Medially Active Waste". This shielding container is formed of concrete or another readily available and inexpensively manufactured material with good shielding properties, such as cast iron. The top surface of the container has undercuts for attaching gripper-tools, the undercuts being lined with an anchoring sheeting. The anchoring extends into the side-wall of the shielding container. The anchoring is formed of metal, so that the forces induced by the gripper tool into the concrete are well distributed into the concrete. Although the Kratz patent appears to disclose undercuts for attaching gripper-tools, the Kratz patent does not appear to disclose lifting lugs as described herein and does not appear to disclose container adaptor means capable of being connected to the lifting lugs for reacting torque and lifting loads and for lifting the container.

Carriers or transporters for radioactive slugs or capsules that have been exposed to radiation in a neutronic reactor or the like are disclosed in U.S. Pat. No. 2,514,909 issued July 11, 1950, in the name of Gerald Strickland entitled "Carrier for Radioactive Slugs". The body of the carrier disclosed in the Strickland patent has lateral carrying or body lifting arms enabling operators to lift and carry the transporter about. At the upper end of the body is a tapered opening or recess. A closure member in the form of a tapering plug shaped to fit into and close the opening is disclosed. The plug has other lifting arms that normally rest in U-shaped grooves in the body so that the top of the plug is flush with the top of the body. Although the Strickland patent appears to disclose lifting arms that rest in U-shaped grooves in the body, the Strickland patent does not appear to disclose lifting lugs completely disposed within and attached to a plurality of pockets recessed in the surface of the container as described herein. Moreover, the Strickland patent does not appear to disclose container adaptor means for reacting torque and lifting loads and for lifting the container.

Although the patents recited hereinabove disclose various containers for radioactive waste, these patents do not appear to disclose the volumetrically efficient container apparatus described herein.

Therefore, what is needed is a volumetrically efficient radioactive waste container apparatus, wherein the container apparatus includes a plurality of pockets recessed into the outside surface of the container, a plurality of lifting lugs each completely disposed within and attached to each pocket and further includes container adaptor means capable of being connected to the lifting lugs for reacting torque and lifting loads and for lifting the container.

SUMMARY OF THE INVENTION

Disclosed herein is a volumetrically efficient radioactive waste container apparatus, wherein the container apparatus includes a plurality of pockets recessed into the outside surface of the container, a plurality of lifting lugs each completely disposed within and attached to the inside surface of each pocket and further includes container adaptor means capable of being connected to the lifting lugs for reacting torque and lifting loads and for lifting the container.

A container suitable for containing radioactive waste slurry solids has an opening in the top end of the container for providing means for filling the container with the waste. The opening does not have a fill connection or flange that protrudes beyond the external surface of the top of the container. The outside surface of the container defines a marginal edge extending around the top end of the container. As disclosed more fully hereinafter, a plurality of open pockets are recessed into the marginal edge and are preferably equidistantly distributed around the marginal edge for evenly distributing the lifting load around the top end of the container. Although the pockets are recessed into the container, they are positioned near the top end of the container where a predetermined minimum freeboard or unused volume is preferably maintained inside the container for proper mixing of the waste and to prevent overflow of the container by the waste transferred therein. Therefore, the pockets occupy only a relatively small volume of the container that is not normally occupied by the waste. Disposed within each pocket is a lifting lug for providing a lift point for the container. The lifting lugs do not protrude beyond the external surface of the container because they are completely disposed within the pockets. Because a protruding fill connection is not present and because the lifting lugs do not protrude beyond the external surface of the container, the volume of the external envelope defined by the container is minimized. Moreover, minimizing the unused volume of the external envelope means that the volume of the container may be increased, if desired, to occupy the volume that otherwise would have been occupied by a protruding fill neck and by protruding lifting lugs. Increasing the volume of the container in this manner will increase the volume of waste that may be transferred into the container. Therefore, the volume of the external envelope defined by the container is minimized while the volume of the waste placeable within the container is capable of being maximized; hence, the container is volumetrically efficient.

The container apparatus includes container adaptor means capable of being connected to the lifting lugs for reacting torque and lifting loads and for lifting the container. The adaptor means comprises an angle iron having an outside surface, a top end, and a cavity therethrough. A rolled angle circumscribes the top end of the angle iron and outwardly projects therefrom for receiving hoist gear that is capable of lifting the container apparatus. A plurality of lifting brackets are distributed around the outside surface of the angle iron like spokes on a wheel hub for reacting torque and lifting loads and for lifting the container. A plurality of arms extend from the the wall of the cavity a predetermined distance into the cavity like spokes in a wheel rim. A pair of elongated first stiffeners are attached to each lifting bracket at one end of each first stiffener and attached to the angle iron at the other end of each first stiffener for resisting the torque produced by a motor connected to the adaptor means. A pair of elongated second stiffeners each having one end thereof attached to each arm and having the other end thereof attached to a process flange resists the torque produced by the motor. The motor is attached to the process flange; therefore, the torque which is used to rotate mixing blade assembly connectable to the motor is transferred to the arms and thence to the lifting brackets. The lifting brackets in turn transfer that portion of the torque to the lifting lugs That is, the torque used to rotate the mixing blade is reacted by the process flange through the arms and the second stiffeners to the lifting bracket and the first stiffeners and then to the container lifting lugs Moreover, the lifting lugs are attached within the pockets such that the lifting lugs will experience shear loading rather than tensile loading when the container apparatus is lifted by the hoist gear.

Therefore, an object of the invention is to provide a volumetrically efficient container apparatus having a plurality of pockets recessed into the outside surface of the container and a plurality of lifting lugs each completely disposed within and attached to the inside surface of each pocket for lifting the container.

Another object of the invention is to provide container adaptor means capable of being connected to the lifting lugs for reacting torque and lifting loads and for lifting the container.

These and other objects of the invention will become apparent upon a reading of the following detailed description when taken in conjunction with the drawings wherein there is shown illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings wherein:

FIG. 4 is a plan view of the first embodiment of the invention showing the container adaptor means mounted atop the container and connected to a plurality of lifting plates belonging to the container;

FIG. 4A is a view in perspective of an attachment bolt and a release pin inserted through the attachment bolt;

FIG. 8 is an orthogonal view of a lifting hook belonging to the second embodiment of the invention, the lifting hook engaging a lifting bar; and FIG. 9 is view in partial vertical section illustrating the lifting hook pivoting into engagement with the lifting bar.

DESCRIPTION OF THE PREFERRED EMBODIMENTS

First Embodiment of the Invention

Owners of radioactive waste containers that are to be buried are assessed certain burial fees or charges. The charges assessed the owner of the container to be buried are directly proportional to the volume of the external envelope defined by the container. Therefore, it is desirable to design a volumetrically efficient waste container that minimizes the volume of the external envelope as it maximizes the volume of waste capable of being buried.

Figure 1:
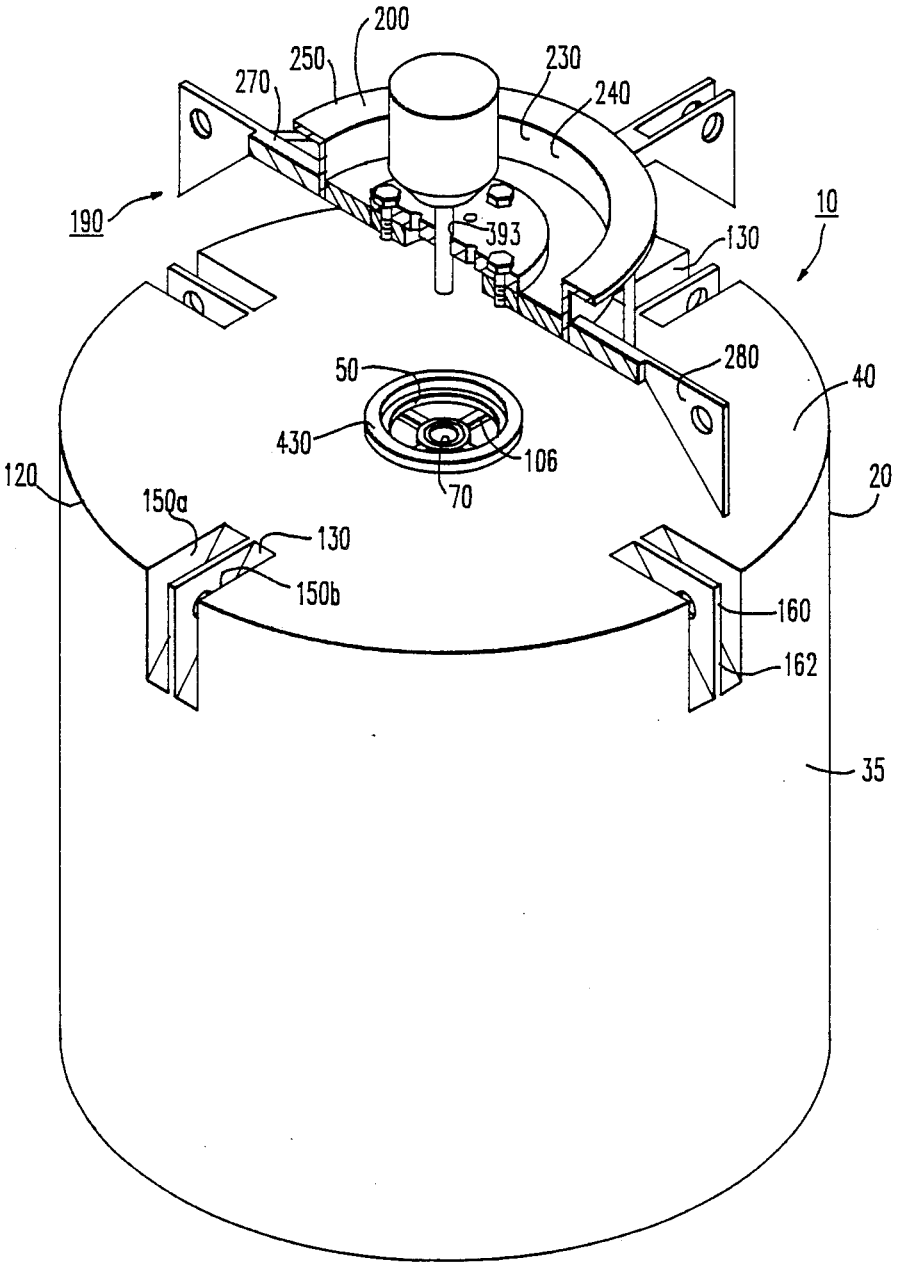
FIG. 1 is an orthogonal view in partial vertical section of a first embodiment of the invention showing a container and a container adaptor means disposed above the container.
Figure 2:
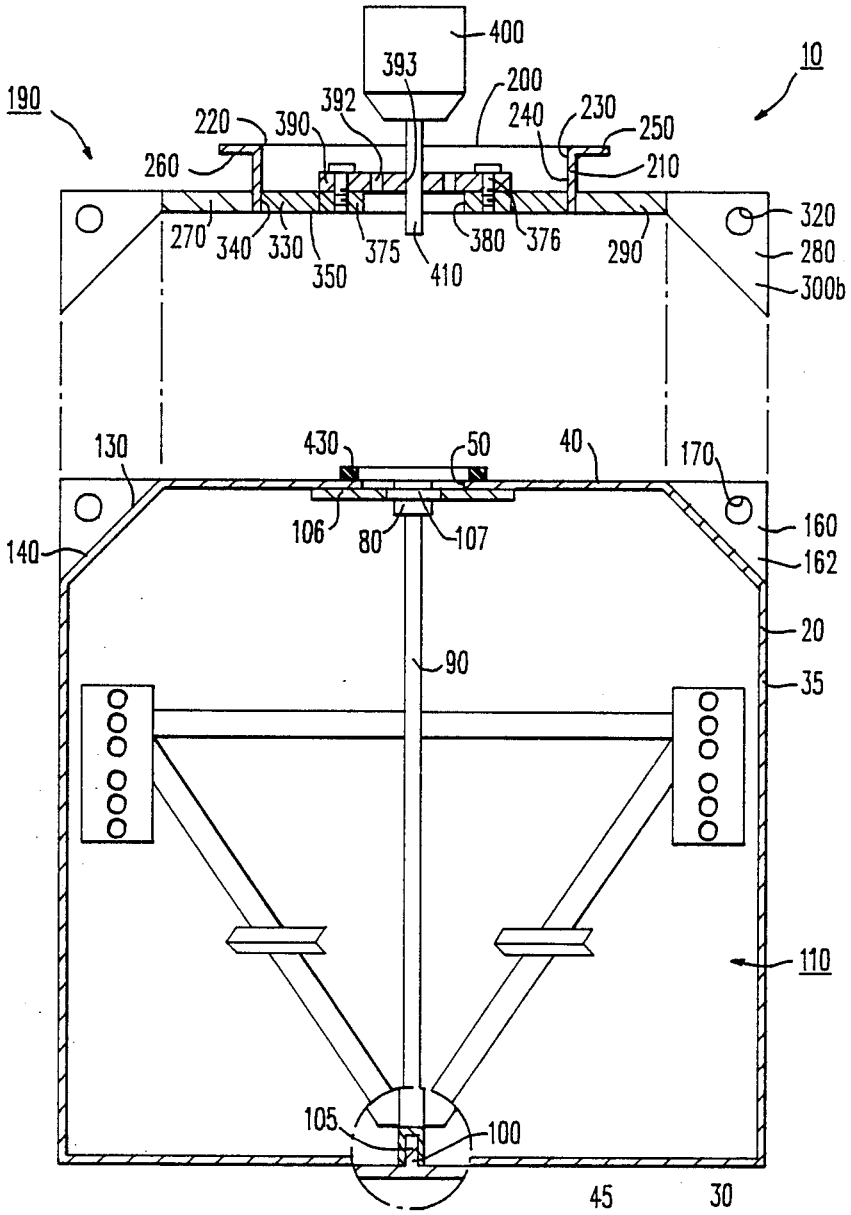
FIG. 2 is a view in partial vertical section of the first embodiment of the invention illustrating the container and illustrating the container adaptor means disposed above the container.

Referring to FIGS. 1 and 2, there is illustrated a container apparatus, generally referred to as 10. Container apparatus 10 comprises a generally cylindrical vessel or container 20 for holding matter such as radioactive waste slurry solids (not shown). Container 20 may be formed from a suitable non-porous material, such as carbon steel, so that gas, waste solids, and/or liquid can not pass through container 20. Container 20 has a closed bottom end 30, a longitudinal side 35, and a top end 40. Bottom end 30 has a top surface 45 thereon facing top end 40. Formed through top end 40 of container 20 is an opening 50 for transferring the waste into container 20. For reasons to be described in more detail hereinafter, opening 50 is capable of matingly sealingly receiving therein a generally cylindrical drive coupling 80. Rotatably coupled to drive coupling 80 is a substantially vertical rotatable mixer shaft 90 extending from drive coupling 80 to top surface 45. Mixer shaft 90 has a female socket 100 for matingly receiving a male extension 105 upwardly extending from top surface 45. Female socket 100 receives male extension 105 so that mixer shaft 90 remains substantially vertical and rotatable. Mixer shaft 90 is thus capable of rotating about its longitudinal axis because it is rotatably connected to drive coupling 80 and to male extension 105. Attached to drive coupling 80 and to top end 40 is support means, such as a plurality of rigid wires 106 (only four of which are shown) connected to an annular collar 107 adapted to receive drive coupling 80 for maintaining and for supporting mixer shaft 90 and drive coupling 80 in a substantially vertical orientation. A mixing blade assembly, generally referred to as 110, is disposed in container 20 for mixing and for substantially homogenizing the waste. Mixing blade assembly 110 is fixedly attached to mixer shaft 90 such that mixing blade assembly 110 rotates as mixer shaft 90 rotates. Thus, as mixing blade assembly 110 rotates it mixes and substantially homogenizes the waste transferred into container 20 because mixing blade assembly 110 will be in intimate communication with the waste transferred into container 20.

As described in more detail hereinbelow, container 20 minimizes the volume of the external envelope defined by container 20. Moreover, container 20 may be sized, as described hereinbelow, to maximize the volume of the waste to be buried. It is important that the volume of the envelope defined by container 20 is minimized and that the volume of the waste to be buried is maximized. This is important for at least three reasons. First, waste container owners are assessed burial fees proportional to the volume of the external envelope defined by container 20. That is, the smaller the volume of the envelope, the smaller the amount of fees assessed. Therefore, it is desirable to minimize the volume of the external envelope defined by container 20. Secondly, containers such as container 20 are typically placed into shielding transportation casks for transport to a burial site; hence, the external envelope of container 20 is generally limited by the cavity of the transportation cask into which it is placed. Therefore, for this reason also, it may be necessary to limit the volume of the external envelope defined by container 20. Thirdly, waste container owners may achieve the minimum ratio of total costs per unit volume (e.g., dollars per cubic feet) of waste buried by maximizing the volume of waste buried in a single container. It will be understood that the quantity or volume of the waste to be buried will be maximized if the volume of container 20 is increased to occupy that portion of the external envelope otherwise occupied by protruding fill necks, structural members, and lifting lugs.

Figure 3:
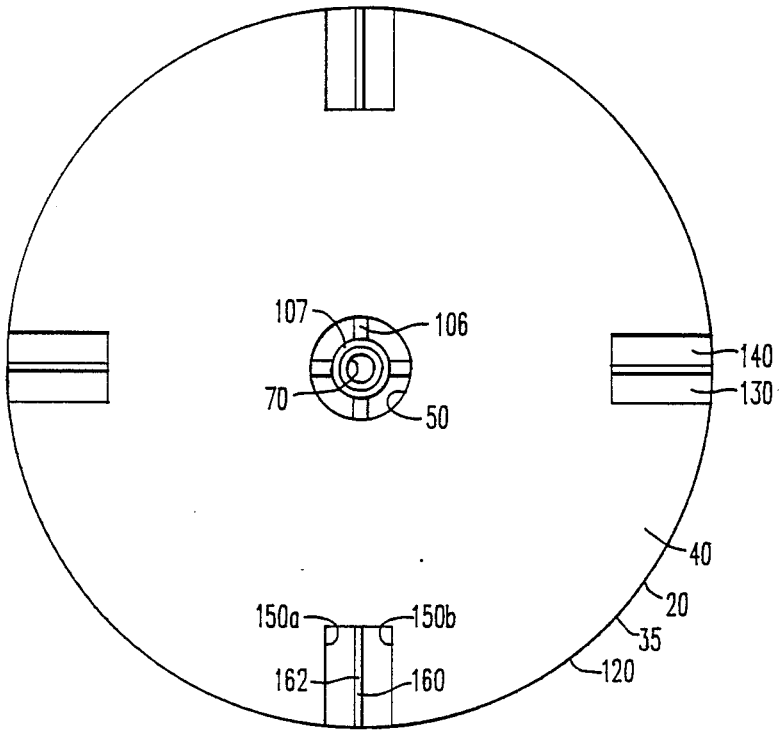
FIG. 3 is a plan view of the container belonging to the first embodiment of the invention.
Figure 5:
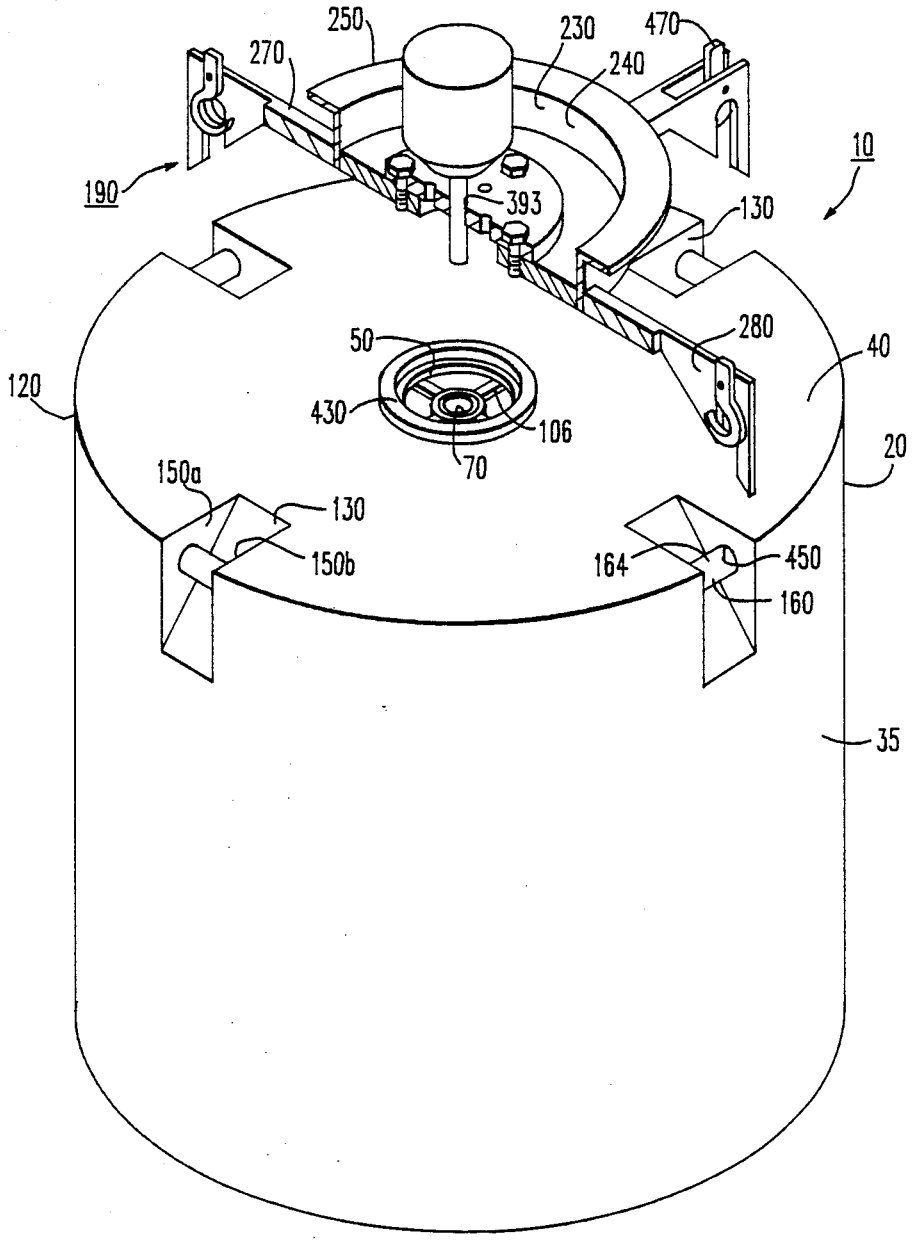
FIG. 5 is an orthogonal view in partial vertical section of a second embodiment of the invention showing a container and a container adaptor means disposed above the container.
Figure 6:
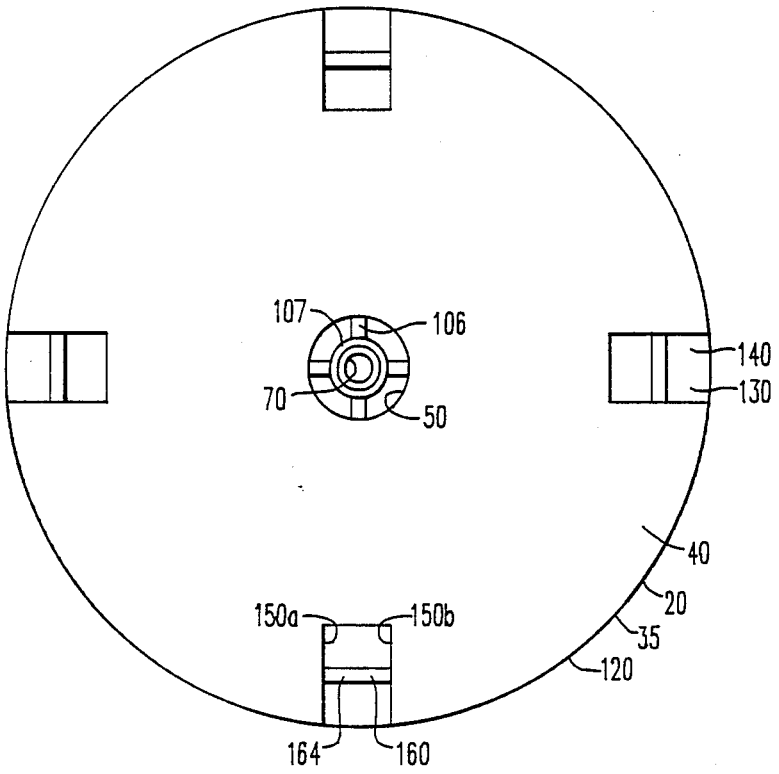
FIG. 6 is a plan view of the second embodiment of the invention.
Figure 7:
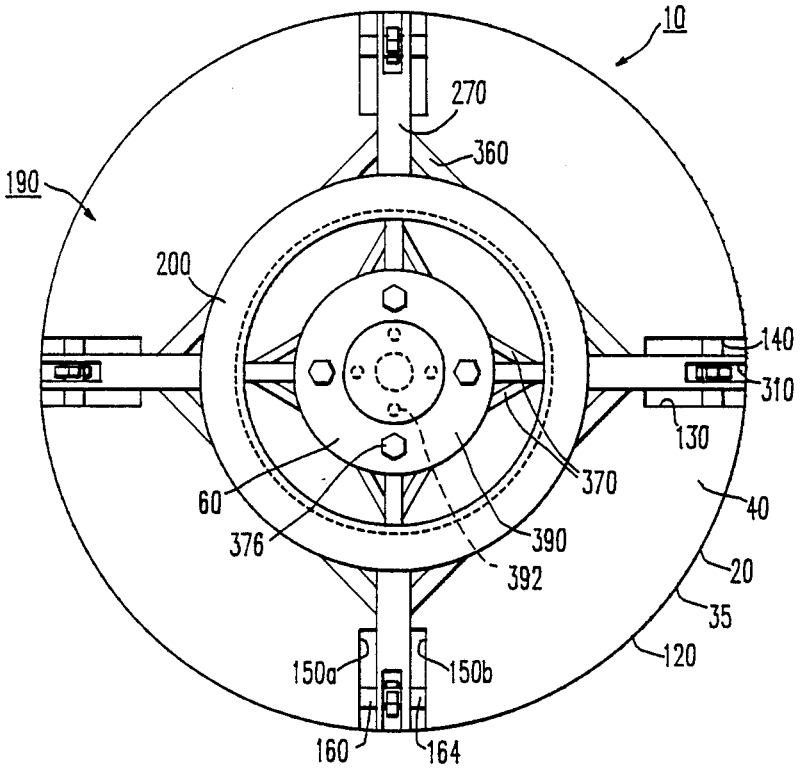
FIG. 7 is a plan view of the second embodiment of the invention showing the container adaptor means mounted atop the container and connected to a plurality of lifting bars belonging to the container.

Referring to FIGS. 1, 2, and 3 the outside surface of container 20 defines a marginal edge 120 extending around top end 40 of container 20. A plurality of open pockets 130 are recessed into marginal edge 120 of top end 40 and are preferably equidistantly distributed around marginal edge 120 for evenly distributing the lifting load around top end 40, as described in more detail hereinafter. Even distribution of the lifting load around top end 40 enables container 20 to remain substantially level while being lifted and also enables the lifting load applied at any one pocket 130 to be substantially no greater or substantially no less than the lifting load applied at any other pocket 130. Of course, it will be understood that even distribution of the lifting load among the plurality of pockets 130 reduces the risk that any of the pockets 130 will be damaged by excessive material stress caused by asymmetrical loading. It will be appreciated that although pockets 130 are recessed into container 20, they are positioned near top end 40 where a predetermined minimum freeboard or unused volume is typically maintained for proper mixing of the slurry solids and to prevent overflow of container 20 by the slurry solids transferred therein. Therefore, pockets 130 principally occupy a volume of container 20 that is not normally occupied by the waste. Each pocket 130 may comprise a planer inclined pocket floor 140 upwardly extending from side 35 to top end 40 of container 20. Integrally formed with pocket floor 140 are a plurality of pocket walls 150*a* and 150*b* disposed parallel one to the other and extending vertically upwardly from pocket floor 140. Pocket walls 150*a*, 150*b* and pocket floor 140 are recessed in and integrally formed with container 20. Thus, pocket walls 150*a*, 150*b* and pocket floor 140 together define recessed open pocket 130. It will be appreciated that pocket walls 150*a* and 150*b* and pocket floor 140 do not protrude beyond the outside surface of container 20. Disposed completely within each pocket 130 is a lifting lug 160 for providing lift points for container 20. Lifting lug 160, which may be carbon steel or the like, may be a generally triangular vertical lifting plate 162 having one edge integrally attached, such as by welding, to pocket floor 140 Lifting lug 160 is preferably disposed completely within pocket 130 so that no marginal edge of lifting lug 160 protrudes beyond the outside surface of container 20. It is important that lifting lug 160 be completely disposed within pocket 130 because the external envelope defined by container 20 should not increase by the presence of lifting lug 160. Lifting lug 160 has a transverse hole 170 for receiving an attachment bolt 180 therethrough (see FIGS. 2 and 4). As stated hereinabove, lifting lug 160, and thus lifting plate 162, provide a lift point for lifting container 20. It will be appreciated that when lifting plate 162 is pulled, in order to lift container 20, the attachment points where lifting plate 162 is attached to inclined pocket floor 140 will experience a substantially shear load rather than a substantially tensile load Therefore, because the attachment points will experience a substantially shear loading rather than tensile loading, lifting plate 162 will withstand a greater lifting load and will tend to resist separation from container 20 as container 20 is lifted. Alternatively, lifting lug 160 may be a generally cylindrical lifting rod or bar 164 (see FIGS. 5, 6, and 7) having one end thereof attached to wall 150*a* and having the other end there of attached to wall 150*b* for providing a lift point for container 20.

Referring to FIGS. 1, 2 and 4, container apparatus 10 also includes container adaptor means, generally referred to as 190. As described in more detail hereinafter, container adaptor means 190 is capable of being connected to lifting lugs 160 for reacting torque and lifting loads and for lifting container 20. Container adaptor means 190 comprises a generally cylindrical angle iron 200 having an outside surface 210 and a top end 220. Angle iron 200 defines a cavity 230 longitudinally therethrough having a cavity wall 240. Top end 220 of angle iron 200 perpendicularly outwardly projects from angle iron 200 and has an underside lift surface 260 thereon for receiving a plurality of grappling hooks (not shown) thereagainst. The grappling hooks may be used for lifting container adaptor means 190 and container 20.

Still referring to FIGS. 1, 2, and 4, a plurality of elongated lifting brackets 270 are distributed around outside surface 210 of angle iron 200 like spokes on a wheel hub. Lifting brackets 270 each has a first end thereof attached to outside surface 210. Each lifting bracket 270 outwardly perpendicularly extends from outside surface 210 for reacting torque and lifting loads and for lifting container 20. Lifting brackets 270 each has a second end opposite the first end thereof. Integrally formed with the second end of lifting bracket 270 is an attachment member 280 for attaching lifting bracket 270 to lifting lug 160. Attachment member 280 may be a depending fork 290 having two oppositely disposed spaced-apart tines 300*a* and 300*b* defining a gap 310 therebetween for receiving lifting plate 162. Coaxially transversely formed through each tine 300*a* and 300*b* is a hole 320 that is colinearly alignable with hole 170 formed through lifting plate 162. Holes 320 and 170 are preferably of the same diameter and are capable of being aligned such that an attachment bolt 180 can pass through holes 320 and 170. Attachment bolt 180 may have a screw threaded shank portion for reasons to be described presently. Attachment bolt 180 may also have a head at one end of its shank portion that is of diameter larger than holes 320 and 170 so that the head will abut either one of tines 300*a* or 300*b* and will not pass through holes 320 and 170. Moreover, attachment bolt 180 may also include a screw-threaded nut capable of threadably engaging the threads (not shown) of the shank portion of attachment bolt 180 and capable of being threadably run-down the shank portion of attachment bolt 180 until the nut tightly abuts either one of tines 300*a* or 300*b* depending on the orientation of attachment bolt 180 through holes 320 and 370 (i.e., whether attachment bolt 180 is oriented so that the bolt head abuts tine 300*a* or so that the bolt head abuts tine 300*b*). Alternatively, and as shown in FIG. 4A, attachment bolt 180 may have a transverse hole 182 through the end thereof opposite the head of attachment bolt 180. Hole 182 is capable of receiving a quick-release retention pin 184 or the like for retaining attachment bolt 180 in holes 320 and 170. Retention pin 184 is extracted from hole 182 by simply pulling retention pin 184 from hole 182. Conversely, retention pin 184 is inserted into hole 182 by simply pushing retention pin 184 into hole 182. Retention pin 184 is configured so that it is capable of remaining in hole 182 until it is extracted. In this manner attachment member 280 securely attaches lifting bracket 270 to lifting plate 162. Because each lifting bracket 270 is connected to each lifting lug 160 (i.e., lifting plate 162) that is disposed in each pocket 130, the plurality of lifting brackets 270 will evenly distribute the lifting load around top end 40 of container 20. This is so because lifting lugs 160 are evenly distributed around top end 40 of container 20. Even distribution of the lifting load around top end 40 enables container 20 to remain substantially level as it is lifted by lifting brackets 270 and also enables the lifting load applied at any one lifting lug 160 to be substantially no greater or substantially no less than the lifting load applied at any other lifting lug 160 (i.e., lifting plate 162).

Referring to FIGS. 1, 2, and 4, angle iron 200 further comprises a plurality of elongated arms 330 outwardly perpendicularly extending from cavity wall 240 a predetermined distance into cavity 230 for reasons to be described presently. That is, each arm 330 has a first end 340 attached, such as by welding, to cavity wall 240 and a second end 350 terminating in cavity 230. Thus, the plurality of arms 330 extend inwardly from cavity wall 240 towards the longitudinal axis of angle iron 200 like spokes from a wheel rim. Also attached to angle iron 200 is torque resisting means for resisting or reacting torque. The torque resisting means includes a plurality of elongated first stiffeners 360 (see FIG. 4) for resisting the torque. Each first stiffener 360 has one end thereof integrally attached, such as by welding, to an associated lifting bracket 270. Each first stiffener 360 also has the other end thereof integrally attached, such as by welding, to outside surface 210 of angle iron 200. As shown in FIG. 4, each first stiffener 360 laterally extends at a predetermined angle from its associated lifting bracket 270 to outside surface 210. Also as shown in FIG. 4, two first. stiffeners 360 are attached to opposite vertical sides of each lifting bracket 270. Moreover, the torque resisting means further includes a plurality of elongated second stiffeners 370 for resisting the torque. Each second stiffener 370 laterally extends a predetermined distance at a predetermined angle from arm 330 into cavity 230 so that one end of each second stiffener 370 is integrally attached, such as by welding, to arm 330 associated therewith while the other end of each second stiffener 370 terminates in cavity 230. As shown in FIG. 4, two second stiffeners 370 are attached to opposite vertical sides of each arm 330. Therefore, as stated hereinabove, each second stiffener 370 and arm 330 extend into cavity 230 a predetermined distance. Attached, such as by welding, to second end 350 of each arm 330 and attached, such as by welding to the end of each second stiffener 370 terminating in cavity 230 is a horizontally disposed annular disk-shaped inner flange 375. As shown in FIG. 2, a process flange 390 is removably attached, such as by screw threaded studs 376, to inner flange 375. Inner flange 375 defines a generally cylindrical passage 380 (see FIG. 2) for reasons to be described presently.

Still referring to FIGS. 1, 2, and 4, mounted atop second stiffeners 370 and arms 330 is the generally disk-shaped process flange 390 having at least one aperture 392 therethrough in communication with passage 380 and also having an orifice 393 therethrough coaxially aligned with passage 380. Process flange 390 supports rotation means, such as motor 400, which is used to mix and substantially homogenize the waste disposed in container 20. Motor 400, which may be attached to process flange 390, has a drive shaft 410 connected thereto, the drive shaft 410 extending from motor 400, through orifice 393 and through passage 380. Drive shaft 410 is capable of being removably connected (e.g., by slip fit) to drive coupling 80. Orifice 393 has a diameter large enough to receive drive shaft 410 therethrough. Preferably, each aperture 392 (of which there may be more than one) is of a diameter large enough to receive therethrough, if desired, a process conduit such as a fill conduit (not shown) for transferring the waste into container 20. In addition, a dewatering conduit (not shown) may extend from a vacuum pump (not shown), through opening 50, and to a location near top surface 45 for suctioning excess water from the slurry solids being transferred into container 20. Removal of excess water from the slurry solids increases the total mass of slurry solids placeable in container 20. Furthermore, a temperature probe (not shown) may be disposed through opening 50 and into container 20 for monitoring the temperature of the slurry solids. The temperature probe .provides means for early identification of exothermic reactions in the slurry solids, thereby increasing operator and equipment safety. Moreover, disposed through opening 50 and into container 20 may be a level probe (not shown) electronically and/or mechanically connected to a level probe monitoring unit (not shown) for monitoring the height or level of the slurry solids within container 20. The level probe should be capable of issuing an alarm if container 20 approaches an overfill condition or if the level of the slurry solids being transferred into container 20 rises into the freeboard or unused volume at top end 40 of container 20 or if the mass of slurry solids becomes too great to properly solidify. It will be understood that drive coupling 80 is connected to mixer shaft 90; thus, drive coupling 80 connects drive shaft 410 to mixer shaft 90 for rotating mixing blade assembly 110 so that the waste, such as slurry solids, are mixed and homogenized. As stated hereinabove, first stiffeners 360 and second stiffeners 370 are used for resisting or reacting the torque produced by motor 400. In this regard, it will be understood that second stiffeners 370, which are attached to process flange 390 and to arms 330, brace process flange 390 against arms 330 so that process flange 390 remains substantially stationary under the effects of the torque produced by motor 400. Thus, second stiffeners 370 resist the torque applied to process flange 390 by motor 400. It will also be understood that first stiffeners 360, which are attached to angle iron 200 and to lifting brackets 270, brace angle iron 200 against lifting brackets 270 so that angle iron 200 remains substantially stationary under the effects of the torque produced by motor 400. Thus, first stiffeners 360 resist the torque applied to angle iron 200 by motor 400.

Returning to FIG. 2, seal means, such as annular seal 430 may be interposed between process flange 390 and top end 40 of container 20 for maintaining process flange 390 and container 20 in a substantially seal-tight relation to prevent spilling as container 20 is filled with waste. To provide the seal-tight relation referred to immediately hereinabove, seal 430 is removably disposed on top end 40 such that seal 430 is colinearly aligned with inner flange 375. In this manner, seal 430 will sealingly abut inner flange 375 when adaptor apparatus 190 is mounted atop container 20. Moreover, a snap-on lid (not shown), which is shaped to sealingly fit within opening 50 so that the lid is flush with the top of container 20, is disposed in opening 50 for closing opening 50 and for sealing container 20 after container 20 is sufficiently filled with waste. Of course, all process conduits are preferably removed before container 20 is capped.

SECOND EMBODIMENT OF THE INVENTION

Referring to FIGS. 5, 6, 7, 8 and 9 there is shown the second embodiment of the invention. This second embodiment of the invention is similar to the first embodiment of the invention except that the plurality of lugs 160 comprises the plurality of lifting bars 164, rather than the plurality of lifting plates 162. Lifting bars 164 are completely disposed in and attached to pockets 130 for providing lift points for container 20. In this regard, each bar 164 may be a generally cylindrical bar 164 having a first end 440 attached to wall 150*a* and a second end 450 attached to wall 150*b*. Referring to FIGS. 8 and 9, each tine 300*a* and 300*b*, which belongs to fork 290, has an open archway 460 for receiving bar 164 therethrough. Gap 310, which is defined by tines 300*a* and 300*b*, is capable of receiving a pivotable lifting hook 470 therein. Lifting hook 470 has a rounded cradle 480 formed therein for matingly receiving bar 164. Lifting hook 470 is pivotally attached to each tine 300*a* and 300*b* by a pivot pin 490 extending transversely through each tine 300*a* and 300*b* and through lifting hook 470 for allowing lifting hook 470 to pivot. Lifting hook 470 is capable of being pivoted outwardly from tines 300*a* and 300*b* until torque adaptor apparatus 190 is mounted atop container 20, at which time lifting hook 470 may be pivoted inwardly towards tines 300*a* and 300*b* such that bar 164 is received in cradle 480 for lifting container 20.

OPERATION OF THE FIRST EMBODIMENT OF THE INVENTION

During operation of container apparatus 10, hoist gear, such as grappling hooks (not shown), are received on lift surface 260 which belongs to angle iron 200. The grappling hooks may in turn be connected to an overhead crane (not shown) for lifting torque adaptor means 190. Torque adaptor means 190 is mounted on top end 40 such that each lifting plate 162 is matingly received in each associated gap 310 defined by each pair of tines 300*a* and 300*b*. Each plate 162 is positioned within its associated gap 310 such that holes 320 in each pair of tines 300*a* and 300*b* colinearly align with the associated hole 170 formed in lifting plate 162. An attachment bolt 180 is passed substantially through holes 320 and 170 for connecting torque adaptor means 190 to container 20. A nut is then run-down attachment bolt 180 until attachment bolt 180 is securely fastened to tines 300*a* and 300*b*. Alternatively, retention pin 184 may be inserted through hole 182 (see FIG. 4A) for securely fastening attachment bolt 180 to tines 300*a* and 300*b*. Of course, when retention pin 184 is used, the nut referred to immediately hereinabove need not be used because retention pin 184 replaces the nut. In this manner torque adaptor means 190 is securely connected to container 20. Next, the waste is transferred into container 20 through aperture 392 formed in process flange 390 and then through opening 50. Torque adaptor means 190 is mounted atop container 20 so that drive shaft 410 is matingly received through orifice 393, through opening 50 and into drive coupling 80. Motor 400 is operated such that the waste is mixed and substantially homogenized by mixing blade assembly 110 as the waste is transferred into container 20. It will be appreciated that as motor 400 is operated, it will develop torque to rotate drive shaft 410 which in turn rotates mixer shaft 90. Of course, as mixer shaft 90 is rotated, mixing blade assembly 110 rotates for mixing and homogenizing the waste. Arms 330 will transfer the effects of this torque to angle iron 200 because arms 330 are attached to angle iron 200 at first end 340 thereof and to process flange 390 at second end 350. Because lifting brackets 270 are attached to angle iron 200 at one end thereof and to lifting lugs 160 at the other end thereof, the torque will be transferred to lifting lugs 160 via attachment member 280.

Second stiffeners 370, which are attached to arms 330 and to process flange 390, will resist the torque experienced by process flange 390. First stiffeners 360, which are attached to angle iron 200 at one end thereof and to lifting brackets 270 at the other end thereof, will resist the torque experienced by angle iron 200.

Waste may continue to be transferred into container 20 until the level of the waste reaches a predetermined level in container 20. The predetermined level mentioned immediately above is a level such that a minimum freeboard or unused volume near the top end 40 of container 20 is maintained for proper mixing of the waste, after addition of a suitable solidification agent, and to prevent overflow of container 20 by the waste transferred into container 20. It will be understood that container 20 may be equipped with a level probe (not shown) for monitoring the height or level of the waste within container 20. When the height of the waste reaches the freeboard or unused volume in container 20, the level probe could issue an alarm to the operator of container apparatus 10 so that the transfer of waste into container 20 may be terminated. Moreover, as the waste is transferred into container 20, a dewatering conduit (not shown), which is connected to a vacuum pump (not shown) at one end thereof and is in communication with the waste at the other end thereof, may be used to vacuum excess liquid (e.g., water) from the waste. When dewatering is performed, the waste is sufficiently dewatered when only a predetermined amount of water remains for proper hydration. In addition, the temperature of the waste being transferred into container 20 may be monitored by a temperature probe (not shown) for early identification of exothermic reactions in the waste. When the waste reaches the predetermined level in container 20, transfer of the waste through aperture 392 and opening 50 is terminated. A predetermined amount of cement or the like may be added to and sufficiently mixed with the waste for solidifying the waste. After container 20 is sufficiently filled with waste, any process conduits (e.g., waste level probe, dewatering conduit, temperature probe) are removed by withdrawing the conduits from container 20 through apertures 392 and orifice 50 Thereafter, container 20 may be hoisted onto suitable transportation means (not shown) for transport to an appropriate burial site It is appreciated that grappling hooks (not shown) or the like, a crane (not shown), and torque adaptor means 190 are used to hoist container 20 aboard the transportation means for transport to the burial site The grappling hooks are received on underside surface 260 belonging to torque adaptor means 190. As the grappling hooks lift container apparatus 10 upwardly by means of the crane to which the grappling hooks are connected, a lifting force is transferred to lifting brackets 270 and thus to lifting lugs 160. The amount of lifting force necessary to lift container 20 is proportional to the mass of waste disposed in container 20. When lifting lug 160 is lifting plate 162, the lifting load applied to the points of attachment between lifting plate 162 and pocket floor 140 will be a substantially shear load rather than a tensile load. Shear loading is preferable to tensile loading because lifting plate 162 will be capable of withstanding relatively more load when plate 162 is under shear loading.

As stated hereinabove, container 20 is hoisted aboard the transportation means for transport to the burial site. After container 20 is placed aboard the transportation means, torque adaptor means 190 is disconnected from container 20 by removing each attachment bolt 180 or by disengaging lifting hook 470 from bar 164. Torque adaptor means 190 may then be dismounted from atop container 20 by engaging the grappling hooks with underside surface 260 and by using the crane to which the grappling hooks are connected to remove adaptor means 190 from the vicinity of container 20. Container 20 may then be shipped to the burial site. It will be appreciated that torque adaptor means 190 together with motor 400 may be reused for preparation of another container 20 for shipment.

OPERATION OF THE SECOND EMBODIMENT OF THE INVENTION

Operation of the second embodiment of the invention is similar to the operation of the first embodiment of the invention except that each bar 164 is received into each associated archway 460. However, each lifting hook 470 is pivoted outwardly (see FIG. 9) from its associated tines 300*a* and 300*b* so that bar 164 can be received through its associated archway 460. After bar 164 is suitably received through archway 460, lifting hook 470 is then pivoted about pivot pin 490 sufficiently inwardly toward tines 300*a* and 300*b* such that bar 164 is received into cradle 480 of lifting hook 470 for lifting container 20 by bars 164.

Of course, it will be appreciated that modifications and variations may be effected without departing from the spirit and scope of the novel concepts of the present invention.

Therefore, this invention provides a volumetrically efficient radioactive waste container apparatus, wherein the container apparatus includes a plurality of pockets recessed into the outside surface of the container, a plurality of lifting lugs each completely disposed within and attached to each pocket and further includes container adaptor means capable of being connected to the lifting lugs for reacting torque and lifting loads and for lifting the container.

What is claimed is:

1. An apparatus for containing radioactive matter, comprising:

(a) a vessel for holding the matter, said vessel having an outside surface;

(b) a plurality of pockets recessed into the outside surface of said vessel, each of said pockets having an inside surface;

(c) a plurality of lifting lugs each integrally attached to the inside surface of each of said pockets for providing lift points for said vessel; and (d) container adaptor means connectable to said lifting lugs for reacting torque and lifting loads and for lifting said vessel, said container adaptor means mounted atop said vessel.

2. The apparatus according to claim 1, wherein said container adaptor means further comprises:

(a) an angle iron defining a cavity therethrough having a cavity wall, said angle iron having an outside surface;

(b) a plurality of lifting brackets attached to the outside surface of said angle iron, each of said lifting brackets outwardly radially projecting from the outside surface of said angle iron to each of said lifting lugs for reacting lifting and torquing loads and for lifting said vessel; and (c) torque resisting means connected to said angle iron for resisting the torque.

3. The apparatus according to claim 2, wherein said angle iron further comprises a plurality of arms outwardly extending from the cavity wall a predetermined distance into the cavity, each of said arms having a first end connected to the cavity wall and having a second end terminating in the cavity.

4. The apparatus according to claim 3, wherein said torque resisting means comprises:

(a) first torque resisting means attached to the outside surface of said angle iron and to said lifting brackets for resisting the torque; and (b) second torque resisting means attached to said arms for resisting the torque.

5. The apparatus according to claim 4, wherein said first torque resisting means comprises a plurality of first stiffeners for resisting the torque, each of said first stiffeners having two ends, each of said first stiffeners integrally attached at one end thereof to said lifting bracket associated therewith and attached at the other end thereof to the outside surface of said angle iron, and each of said first stiffeners laterally extending from its associated lifting bracket to the outside surface of said angle iron.

6. The apparatus according to claim 5, wherein said second torque resisting means comprises a plurality of second stiffeners for resisting the torque, each of said second stiffeners having two ends, each of said second stiffeners laterally extending from said arm a predetermined distance into the cavity, one end of each of said second stiffeners integrally attached to said arm associated therewith.

7. The apparatus according to claim 6, further comprising an annular inner flange integrally attached to said arm and to said second stiffeners, said annular flange defining a passageway therethrough.

8. The apparatus according to claim 7, further comprising a mixing blade disposed in said vessel for mixing the matter.

9. The apparatus according to claim 8, further comprising:

(a) a drive axle connected to said mixing blade for rotating said mixing blade;

(b) torque producing rotation means connected to said drive axle for rotating said drive axle; and (c) a process flange mounted atop said inner flange, said process flange attached to said inner flange, said process flange having at least one aperture therethrough for passage of a process conduit.

10. The apparatus according to claim 9, wherein said rotation means is a motor for rotating said drive axle.

11. An apparatus for containing radioactive material, comprising:

(a) a generally cylindrical vessel for containing the radioactive material, said vessel having a closed bottom end and a top end having an opening therethrough, said vessel having an outside surface defining a marginal edge extending around the top end of said vessel and defining an external envelope;

(b) a plurality of pockets distributed around and recessed into the marginal edge of said vessel for minimizing the external envelope defined by said vessel, said pockets having an inside surface;

(c) a plurality of lifting lugs each disposed within each of said pockets and integrally attached to the inside surface of each of said pockets for providing a plurality of lift points for lifting said vessel; and (d) container adaptor means connectable to said lifting lugs for reacting torque and lifting loads and for lifting said vessel, said container adaptor means mounted on the top end of said vessel.

12. The apparatus according to claim 11, wherein said container adaptor means further comprises:

(a) a generally cylindrical angle iron having a longitudinal cavity therethrough defining a cavity wall, said angle iron having an outside surface and a top end;

(b) a rolled angle circumscribing the top end of said angle iron and outwardly projecting therefrom, said rolled angle having an underside surface for receiving a plurality of grappling hooks thereagainst;

(c) a plurality of lifting brackets distributed around said angle iron perpendicularly to the longitudinal axis of said angle iron, each of said lifting brackets having a first end thereof attached to the outside surface of said angle iron, said lifting brackets outwardly perpendicularly extending from said angle iron for reacting torque and lifting loads and for lifting said vessel, each of said lifting brackets having a second end opposite the first end; and (d) torque resisting means connected to said angle iron for resisting the torque.

13. The apparatus according to claim 12, wherein each of said lifting lugs is a lifting plate extending vertically within said pocket, said plate having a hole therethrough.

14. The apparatus according to claim 13, wherein each of said lifting brackets comprises an attachment member integrally formed with the second end of said lifting bracket for attaching said lifting bracket to said plate.

15. The apparatus according to claim 14, wherein said attachment member is a depending fork having two oppositely disposed tines for receiving said plate therebetween, said tines having coaxial holes transversely therethrough for receiving an attachment bolt, the attachment bolt capable of being inserted through the hole in said plate and through the holes in the tines and capable of being tightened against the tines for attaching the tines to the plate.

16. The apparatus according to claim 15, wherein said angle iron further comprises a plurality of elongated arms outwardly perpendicularly extending from the cavity wall a predetermined distance into the cavity, each of said arms having a first end attached to the cavity wall and a second end terminating in the cavity.

17. The apparatus according to claim 16, wherein said torque resisting means comprises:

(a) a plurality of elongated first stiffeners for resisting the torque, each of said first stiffeners having two ends, each of said first stiffeners integrally attached at one end thereof to said lifting bracket associated therewith and attached at the other end thereof to the outside surface of said angle iron, and each of said first stiffeners laterally extending from its associated lifting bracket to the outside surface of said angle iron; and (b) a plurality of elongated second stiffeners for resisting the torque, each of said second stiffeners having two ends, each of said second stiffeners laterally extending a predetermined distance from said arm, one end of each of said second stiffeners integrally attached to said arm associated with said second stiffener.

18. The apparatus according to claim 17, further comprising an annular inner flange integrally attached to the second end of each of said arms and integrally attached to an end of each of said second stiffeners.

19. The apparatus according to claim 18, further comprising a rotatable mixing blade disposed in said vessel for mixing the material.

20. The apparatus according to claim 19, further comprising:

(a) a generally cylindrical drive axle connected to said mixing blade for rotating said mixing blade;

(b) a motor connected to said drive axle for rotating said drive axle so that said mixing blade rotates for mixing the material; and p1 (c) a disk-shaped process flange mounted atop said inner flange and connected to said inner flange.

* * * * *